US005769318A

United States Patent [19]

Greubel

[11] Patent Number: 5,769,318

[45] Date of Patent: Jun. 23, 1998

[54] CHEMICAL TREATMENT DRIP IRRIGATION DEVICE

[76] Inventor: Philip A. Greubel, P.O. Box 711, Trabuco Canyon, Calif. 92678

[21] Appl. No.: 694,596

[22] Filed: Aug. 9, 1996

[51] Int. Cl.[6] ..... B05B 15/00; A62C 5/02

[52] U.S. Cl. ..... 239/10; 239/310; 239/542

[58] Field of Search ..... 239/542, 10, 310

[56] References Cited

U.S. PATENT DOCUMENTS

| | | | |
|---|---|---|---|
| 2,755,985 | 7/1956 | Finegan | 299/83 |
| 2,820,671 | 1/1958 | McFarland | 239/10 |
| 2,986,340 | 5/1961 | Webb | 239/310 X |
| 3,221,996 | 12/1965 | Emment et al. | 239/542 |
| 3,482,785 | 12/1969 | Chapin et al. | 239/542 |
| 4,161,290 | 7/1979 | Hill | 239/542 X |
| 4,340,179 | 7/1982 | Knapp | 239/310 |
| 4,934,287 | 6/1990 | Guin et al. | 111/7.1 |
| 5,054,690 | 10/1991 | Olson | 239/542 |

*Primary Examiner*—Kevin Weldon

*Attorney, Agent, or Firm*—Stetina Brunda Garred & Brucker

[57] ABSTRACT

A chemical treatment device for delivering nutrient and plant-health chemicals to plants whose water source is from a drip irrigation system. The system includes a housing within which a chemical treatment tablet can be disposed, with the housing having an inlet for a water source upstream of a site of disposition of the tablet and connectible to a drip irrigation water source, and a water outlet downstream from the site of disposition of the tablet. The invention places a chemical treatment tablet in intimate association with water flow from the drip irrigation system to thereby accomplish simultaneous irrigation and chemical treatment of the plants.

27 Claims, 2 Drawing Sheets

Fig. 1
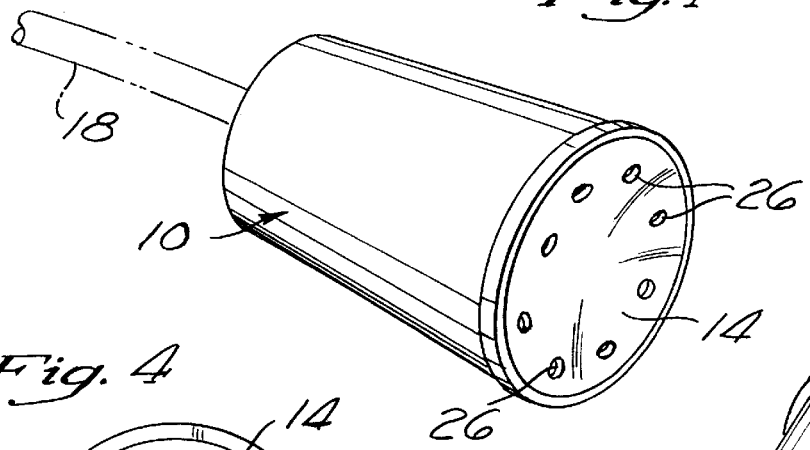
Fig. 4
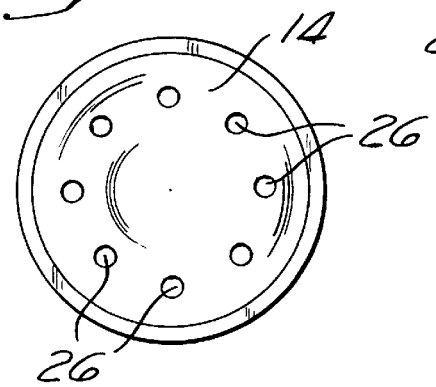
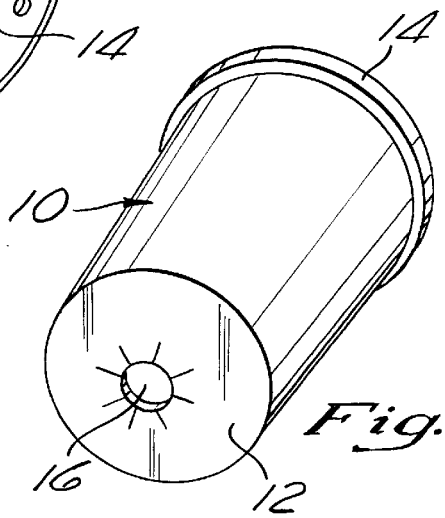
Fig. 2
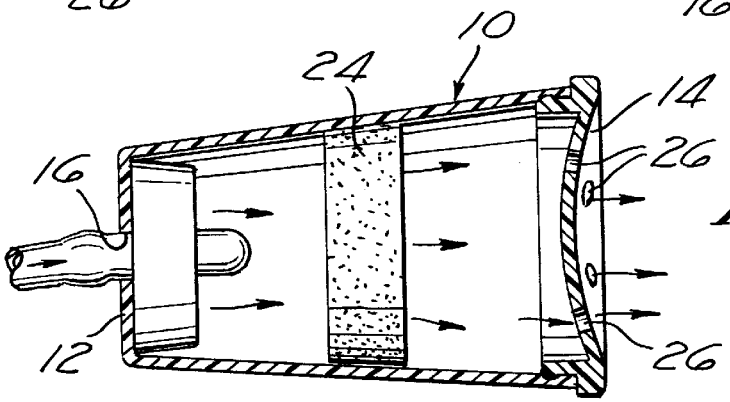
Fig. 3a
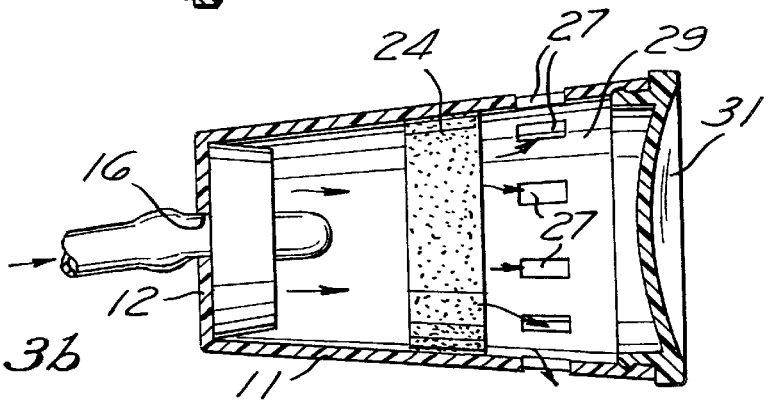
Fig. 3b Fig. 5a
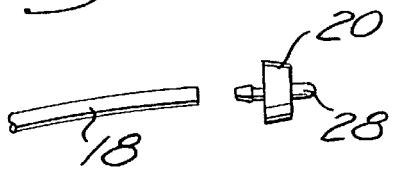
Fig. 5b
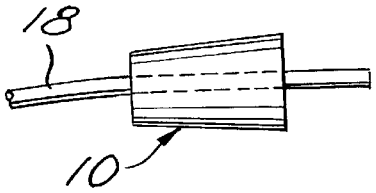
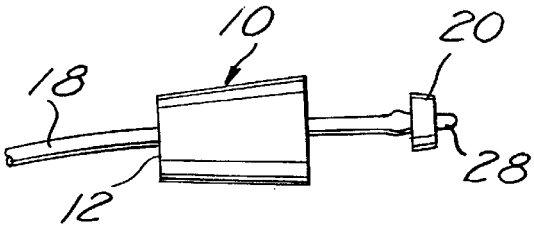
Fig. 5c
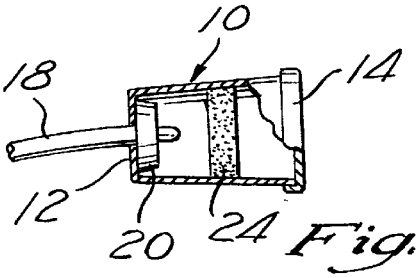
Fig. 5d
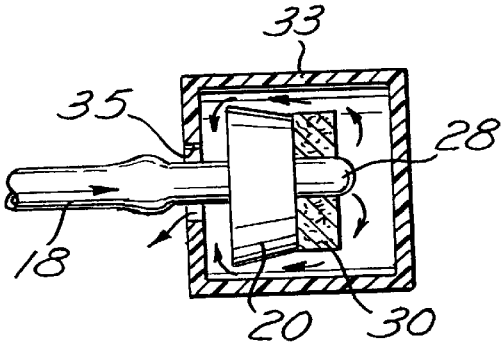
Fig. 6a
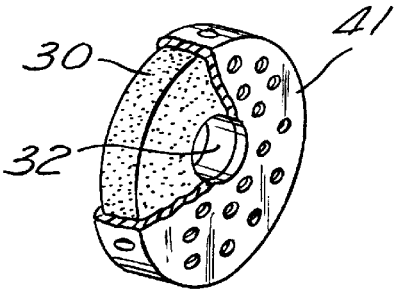
Fig. 6c
Fig. 7
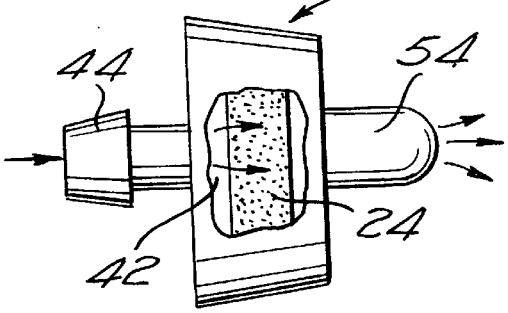
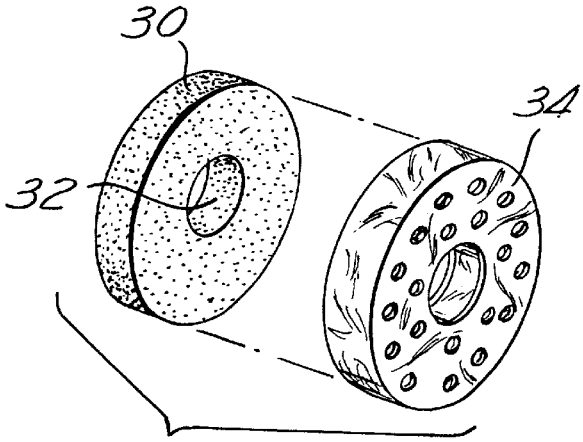
Fig. 6b

CHEMICAL TREATMENT DRIP IRRIGATION DEVICE

FIELD OF THE INVENTION

This invention relates in general to the chemical treatment of plants, and in particular to a drip chemical treatment system wherein a chemical tablet such as a fertilizer tablet is advantageously associated with a drip irrigation emitter of a drip irrigation system to thereby apply treatments at plant sites.

BACKGROUND OF THE INVENTION

Employment of a drip irrigation system for irrigating plants is highly advantageous. First, for example, because the system distributes a low volume of water at a low pressure, it is very efficient in the conservation of water. Second, because the water from drip irrigation systems is delivered through water emitters substantially at and in contact with the site to be irrigated, minimal exposure to the environment of water flow occurs, which translates into minimal loss of water through evaporation.

While water delivery through a drip system is known for its efficiency and practicality, the plants being served by this drip-system water still require chemical treatment such as fertilization, nutrient, or other treatment to maintain proper nutrition of the plants and therefore a sufficient yield of crop. Usual treatment methods include direct placement of compounds on the plants by use of macro-spreaders, placement of cartridges in high pressure water lines from which water is applied to the plants, below-ground injection devices connected to garden hoses, and the like. However, none of these prior art devices or methodologies provides for chemical applications in the same efficient manner as water application is achieved by drip irrigation systems.

Therefore, it is apparent that a need is present for a chemical treatment device that efficiently applies fertilizer, nutrients, pesticides and herbicides, etc. in a controlled and uniform manner. In accord therewith, a primary object of the present invention is to provide a drip chemical treatment device whereby dry chemical-containing tablets can be introduced into water flow emanating from a drip irrigation system.

Another object of the present invention is to provide a drip chemical treatment device wherein a housing containing a treatment tablet can be directly associated with a drip irrigation emitter to thereby permit water to flow around the tablet to erode and/or dissolve and consequently carry components with the water directly to the plants.

Yet another object of the present invention is to provide a drip chemical treatment device wherein an annular-shape fertilizer tablet encased in a perforated sheet is directly associated with a drip irrigation emitter, or the drip irrigation emitter itself has a housing within which a chemical tablet can be placed for subsequent component distribution.

These and other objects of the invention will become apparent throughout the description thereof which now follows.

SUMMARY OF THE INVENTION

The present invention is a drip chemical treatment device for delivering nutrient and plant-health chemicals to plants whose water source is from a drip irrigation system. Broadly, the system comprises a housing within which a chemical treatment tablet can be disposed, with the housing having an inlet for a water source upstream of a site of disposition of the tablet and connectible to a drip irrigation water source, and a water outlet downstream from the site of disposition of the tablet. In one embodiment, the device comprises a housing within which a fertilizer tablet can be disposed. The housing has a first end and a second end, with the first end having an aperture through which tubing from a water source of a drip irrigation system is receivable for connection to a drip irrigation emitter disposed within the housing. The second end has therethrough a plurality of apertures through which water can flow, and the chemical treatment tablet is placeable between the emitter and the second end of the housing. Alternatively, instead of the second end having a plurality of apertures, a distal portion of the housing can have such apertures and the end thereof can be solid. Another embodiment comprises a housing within which a tablet can be disposed and within which a drip irrigation emitter can be accepted. The tablet so housed has an annular shape and a central aperture through which water from the emitter can flow for direction laterally around the tablet and thereafter rearwardly, with the housing having a water outlet rearward of the tablet. Yet another embodiment comprises a drip irrigation emitter connectible to tubing from a water source of a drip irrigation system and having a chamber therein for housing a treatment tablet.

As is apparent, the invention places a treatment tablet in intimate association with water flow from the drip irrigation system to thereby accomplish simultaneous irrigation and chemical treatment of the plants. It is to be understood that the term "chemical" as used throughout is meant to not only include fertilizer food products, but also can include minerals, trace nutrient elements, pesticides and herbicides, and the like as chosen for plant nutrition and health. Because separate and different products can be applied at different sites and/or different times, the present invention provides tremendous versatility over applications requiring a broad coverage irrespective of individual plant needs. Efficient irrigation and treatment can therefore simultaneously occur through the combination of drip irrigation along with drip chemical treatment.

BRIEF DESCRIPTION OF THE DRAWINGS

An illustrative and presently preferred embodiment of the invention is shown in the accompanying drawings in which:

FIG. 1 is a perspective front view of a chemical treatment drip device;

FIG. 2 is a perspective rear view of the device of FIG. 1;

FIG. 3*a* is a side elevation view in section of the device of FIG. 1;

FIG. 3*b* is a side elevation view of an alternate construction of the device of FIG. 1;

FIG. 4 is a front end elevation view of the device of FIG. 1;

FIG. 5*a* is a side elevation view of a drip irrigation emitter and tubing from a water source of a drip irrigation system;

FIG. 5*b* is a side elevation view of the tubing of FIG. 5*a* and the device of FIG. 1;

FIG. 5*c* is a side elevation view of the device of FIG. 1 and the emitter and tubing of FIG. 5*a;*

FIG. 5*d* is a side elevation view of the device, tubing and emitter of FIG. 5c, with the emitter in place;

FIG. 6*a* is a side elevation view, in section, of a ring-shape chemical treatment tablet within a chemical treatment drip device;

FIG. 6*b* is a perspective view of an annular-shape chemical treatment tablet alternatively encaseable in a perforated sheet;

FIG. 6*c* is a perspective view of a chemical treatment tablet within a cage housing; and FIG. 7 is a perspective view, partially in section, of a drip irrigation emitter with a chamber for a chemical treatment tablet.

DETAILED DESCRIPTION OF A PREFERRED EMBODIMENT

Referring to FIGS. 1–3*a* and 5–5*d*, a housing 10 having a first end 12 and a second end 14 is shown. The first end 12 has therethrough an aperture 16 through which tubing 18 from a water source of a drip irrigation system (not shown) is received for connection to a drip irrigation emitter 20 disposed within the housing 10 against a floor surface 22 of the first end 12. The second end 14 of the housing 10 is removable from the housing 10 and held in place by friction fit around its periphery. The second end 14 has a plurality of apertures 26 through which liquid can pass. Alternatively, as shown in FIG. 3*b*, the housing 11 can have apertures 27 disposed through a distal portion 29 thereof, while the second end 31, while still removable, is solid. In all other respects, the construction and operation of the embodiment of FIG. 3*b* is identical to that of FIGS. 1–3*a* and 4–5*d*. The housings are preferably constructed of polyethylene plastic, but, of course, can be made of any appropriate material as would be recognized by a skilled artisan. A chemical treatment tablet, here a fertilizer tablet 24 is placeable within the housing 10 between the emitter 20 and the second end 14 of the housing 10 to thereby position water input upstream of the tablet 24 and water outlet downstream therefrom. Assembly of the system is illustrated in FIGS. 5*a*–5*d*. Specifically, the emitter 20 is removed from the tubing 18 of the water source (FIG. 5*a*) and a length of the tubing 18 is passed through the aperture 16 of the first end 12 (FIG. 5*b*). After such passage of the tubing 18, the emitter 20 is replaced on the tubing 18 (FIG. 5*c*), and pulled rearwardly until situated against the floor surface 22 of the first end 12. The fertilizer tablet 24 is then placed within the housing 10 and the second end 14 is positioned in place.

Operation of the drip fertilization system illustrated in FIGS. 1–5*d* is accomplished by placing a fertilizer tablet 24 within the housing 10 between the emitter 20 and the second end 14. One source for such fertilizer tablets 24 is Fast Forward Concepts of Trabuco Canyon, California, where plant-specific tablet blends are available. Once the tablet 24 is placed in the housing 10 and the second end 14 thereof is reassembled, the housing 10 is positioned as desired for fertilizer dispersal and water is directed through the tubing 18 from the drip irrigation system. Water flow is shown by the arrows of FIGS. 3*a* and 3*b*. As the water passes around the tablet 24, it dissolves and/or erodes (depending upon tablet ingredients) the tablet 24 and carries the fertilizer products thereof through the apertures 26 to the site of desired fertilization. In this manner both irrigation and fertilization occur simultaneously.

Referring to FIGS. 6*a*–6*c*, another embodiment of a drip chemical treatment device is shown. Specifically, as shown in FIG. 6*a*, a housing 33 has disposed therein a drip irrigation emitter 20 connected at its upstream end to tubing 18 while its water-dispersing protrusion 28 extends within a central aperture 32 of an annular chemical treatment tablet such as a fertilizer tablet 30 as shown in FIG. 6*b*. The aperture 32 can include a seat lining as desired for fit around a protruding object such as a pop-up sprinkler head, drip emitter housing, or the like. As is apparent in FIG. 6*a* wherein arrows show water flow, water emits from the protrusion 28 upstream from the tablet 30, laterally around the tablet 30, thereby causing the tablet 30 to be downstream of the water, and thereafter rearwardly, with the housing having a water outlet 35 rearward of the tablet 30. As shown in FIGS. 6*b* and 6*c*, the tablet 30 alternatively can be encased in a perforated structure such as a perforated plastic sheet 34 (FIG. 6*b*) or plastic cage 41 (FIG. 6*c*) which functions to govern dispersal of particles of the encased tablet to thereby provide substantially uniform chemical release. A perforated structure can be included with both solid and apertured tablets.

FIG. 7 illustrates a third embodiment of the invention comprising a drip irrigation emitter 40 with a chamber 42 therein for a fertilizer tablet 24 as shown in the cut-away illustration. The emitter 40 has a connector 44 conventionally connectible to tubing 18 (FIG. 5*a*) from an upstream drip-irrigation water source. The emitter 40 is larger than a regular emitter 20 as shown in FIG. 5*a* so that the tablet 24 can be accommodated, but the connector 44 is of conventional size so that connection to the tubing 18 is standard. When water is directed to the emitter 40, it enters the chamber 42 to bathe the tablet 24 and thereby dissolve and/or erode (depending upon tablet ingredients) the tablet 24 and carry the fertilizer products thereof through the a conventional aperture in the protrusion 54 as shown by the arrows in FIG. 7. Once again, both irrigation and fertilization occur simultaneously.

As is apparent from the above-described preferred embodiments, the present invention achieves drip system distribution of fertilizer along with drip system irrigation. This achievement epitomizes water conservation coupled with plant nourishment while providing superb flexibility in simultaneous fertilizer choices depending upon plant varieties and specific nutrition needs. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A chemical treatment drip irrigation device comprising:

a) a housing, encompassing a drip emitter, having an upstream water inlet for a drip water source and a downstream water outlet; and b) a chamber between the water inlet and the water outlet wherein a chemical treatment tablet can be positioned, downstream of the emitter, such that water entering the water inlet flows through the emitter and follows a single fluid path through the chamber to substantially saturate a tablet therein and carry chemicals from the tablet outwardly through the water outlet for application to a plant.

2. A chemical treatment drip irrigation device as claimed in claim 1 wherein the housing is substantially cylindrical and has a distal end having disposed therethrough the water outlet comprising a plurality of apertures.

3. A chemical treatment drip irrigation device as claimed in claim 1 wherein the housing is substantially cylindrical and has disposed through a distal periphery portion thereof the water outlet comprising a plurality of apertures.

4. A chemical treatment drip irrigation device as claimed in claim 1 wherein the drip water source is a drip water emitter within the housing and with which a tablet having a central aperture therethrough can be in annular association such that water can flow through the central aperture from the emitter and the housing directs said water laterally and rearwardly around the tablet, and wherein the water outlet is rearward of the emitter.

5. A chemical treatment drip irrigation device as claimed in claim 1 wherein the housing is a drip water emitter connectible to a drip irrigation water source.

6. A chemical treatment drip irrigation device comprising:

a) a housing, encompassing a drip emitter, having an upstream water inlet for a drip water source and a downstream water outlet; and b) a chamber between the water inlet and the water outlet having therein a chemical treatment tablet positioned downstream of the emitter such that water entering the water inlet flows through the emitter and follows a single fluid path through the chamber to substantially saturate the tablet and carry chemicals from the tablet outwardly through the water outlet for application to a plant.

7. A chemical treatment drip irrigation device as claimed in claim 6 wherein the housing is substantially cylindrical and has a distal end having disposed therethrough the water outlet comprising a plurality of apertures.

8. A chemical treatment drip irrigation device as claimed in claim 6 wherein the housing is substantially cylindrical and has disposed through a distal periphery portion thereof the water outlet comprising a plurality of apertures.

9. A chemical treatment drip irrigation device as claimed in claim 6 wherein the drip water source is a drip water emitter within the housing and wherein the tablet has a central aperture therethrough in annular association such that water can flow through the central aperture from the emitter and the housing directs said water laterally and rearwardly around the tablet, and wherein the water outlet is rearward of the emitter.

10. A chemical treatment drip irrigation device as claimed in claim 9 wherein the tablet is encased within a perforated structure to facilitate substantially uniform release of chemicals from the tablet.

11. A chemical treatment drip irrigation device as claimed in claim 10 wherein the perforated structure is a perforated plastic sheet.

12. A chemical treatment drip irrigation device as claimed in claim 10 wherein the perforated structure is a cage.

13. A chemical treatment drip irrigation device as claimed in claim 6 wherein the tablet is encased within a perforated structure to facilitate substantially uniform release of chemicals from the tablet.

14. A chemical treatment drip irrigation device as claimed in claim 13 wherein the perforated structure is a perforated plastic sheet.

15. A chemical treatment drip irrigation device as claimed in claim 13 wherein the perforated structure is a cage.

16. A chemical treatment drip irrigation device as claimed in claim 6 wherein the housing is a drip water emitter connectible to a drip irrigation water source.

17. A method for chemically treating a plant, the method comprising:

a) providing a chemical treatment drip irrigation device comprising:

i) a housing having an upstream water inlet for a drip water source and a downstream water outlet;

b) disposing a drip emitter and a chemical treatment tablet in the housing such that water entering the water inlet flows through the emitter and then encounters the tablet to carry chemicals from the tablet outwardly through the water outlet for application to a plant; and c) locating the drip irrigation device at a site of desired treatment of the plant and causing chemically fortified water to flow into the root zone of the plant.

18. A method as claimed in claim 17 wherein the housing is substantially cylindrical and has a distal end having disposed therethrough the water outlet comprising a plurality of apertures.

19. A method as claimed in claim 17 wherein the housing is substantially cylindrical and has disposed through a distal periphery portion thereof the water outlet comprising a plurality of apertures.

20. A method as claimed in claim 17 wherein the drip water source is a drip water emitter within the housing and wherein the tablet has a central aperture therethrough in annular association such that water can flow through the central aperture from the emitter and the housing directs said water laterally and rearwardly around the tablet, and wherein the water outlet is rearward of the emitter.

21. A method as claimed in claim 20 wherein the tablet is encased within a perforated structure to facilitate substantially uniform release of chemicals from the tablet.

22. A method as claimed in claim 21 wherein the perforated structure is a perforated plastic sheet.

23. A method as claimed in claim 21 wherein the perforated structure is a cage.

24. A method as claimed in claim 17 wherein the tablet is encased within a perforated structure to facilitate substantially uniform release of chemicals from the tablet.

25. A method as claimed in claim 24 wherein the perforated structure is a perforated plastic sheet.

26. A method as claimed in claim 24 wherein the perforated structure is a cage.

27. A method as claimed in claim 17 wherein the housing is a drip water emitter connectible to a drip irrigation water source.

* * * * *